United States Patent [19]

Pajevic

[11] 4,296,557

[45] Oct. 27, 1981

[54] SHOE WITH SOLE CUSHIONING ASSEMBLY

[76] Inventor: Paul D. Pajevic, 475 N. Northwest Hwy., Park Ridge, Ill. 60068

[21] Appl. No.: 118,076

[22] Filed: Jan. 31, 1980

[51] Int. Cl.[3] ..... A43B 3/10; A43C 15/00

[52] U.S. Cl. ..... 36/7.8; 36/64

[58] Field of Search ..... 36/7.6, 7.8, 28, 62, 36/64

[56] References Cited

U.S. PATENT DOCUMENTS

| | | | |
|---|---|---|---|
| 1,645,111 | 10/1927 | Michelsen | 36/7.6 |
| 2,408,617 | 10/1946 | Ferrar | 36/7.8 |
| 3,866,339 | 2/1975 | Latto | 36/7.6 |
| 3,996,677 | 12/1976 | Reina | 36/7.8 |
| 4,196,903 | 4/1980 | Illustrato | 36/7.8 |

*Primary Examiner*—Patrick D. Lawson

*Attorney, Agent, or Firm*—Harvey B. Jacobson

[57] ABSTRACT

A shoe containing a cushioned sole assembly includes in one embodiment a spring cushion feature inserted between two flexible hinged sole segments and in a second embodiment a spring cushion fastened to an adjustable hinged spring mounting plate. The cushion assembly can be a part of the shoe manufacture or the assembly can be a separate unit fastened and adjusted to the sole of a shoe by clamp brackets. The sole cushioning assembly can be adapted for any tipe of shoe including jogging and other athletic shoes, protecting the feet of joggers and others from injuries that occur during use on hard surfaces, shoes for workers, providing comfort for those who must stand on hard surfaces for many hours during a day and insulating the feet of the user from surfaces that have extreme hot or cold temperatures.

14 Claims, 13 Drawing Figures

20
22
24
26
28
30
32
34
35
36
37
38
40
42
44
46
48
50
52
54
56
58
60
64
66
89
90
92
94
138
140
142
144
146
148
150
152

78
80
82
76
34
84
96
104
106
102
98
138
140
128
124
136
122
118
160
156
158
100
154
104
108
138
120
119
118
130
134
136
114
110
132
128
122
116
124
112
126
162
166
164
168
170
160
158
100
154

SHOE WITH SOLE CUSHIONING ASSEMBLY

BACKGROUND OF THE INVENTION

1. Field of the Invention

This invention relates to a shoe which contains a sole cushioning assembly. The shoe of the present invention has particular use as a jogging shoe or any type of athletic shoe, protecting the feet of a user from injuries which occur during jogging on or use of hard surfaces, and has other uses such as providing comfort to those who must stand on hard surfaces for many hours of the day and providing insulation from extreme hot and cold surfaces. The sole cushioning assembly can be part of the shoe manufacture or a separate unit which can be mounted and adjusted to fit any type of shoe.

2. Disclosure Statement

Shoes containing springs for amusement or for providing comfort are disclosed in U.S. Pat. No. 1,513,338, issued Oct. 28, 1924, U.S. Pat. No. 1,566,513, issued Dec. 22, 1925, and U.S. Pat. No. 1,858,833, issued May 17, 1932. However, none of these patents teach the structure of the present invention which includes hinged sole plates for maintaining flexibility of the sole of a shoe. In U.S. Pat. No. 2,070,093, issued Feb. 9, 1937, and U.S. Pat. No. 2,595,694, issued May 6, 1952, shoes containing spike or traction elements are disclosed in which the traction elements are joined to hinged plates secured to the sole. These patents do not teach the use of cushion springs for providing comfort.

SUMMARY OF THE INVENTION

The present invention provides a shoe containing a sole cushioning assembly that protects the feet of joggers and other sports enthusiasts from injuries that can occur utilizing hard surfaces, such as sidewalks, streets, parking lots, etc., and that provides comfort to those who are on their feet many hours during a day standing on hard surfaces, such as concrete, or surfaces which are excessively hot or cold. The sole cushioning assembly of the present invention includes a spring cushion feature inserted between a flexible hinged sole segment and a series of rubber cushion pads that make up the surface contacting portion of the shoe.

In one embodiment of the present invention, the spring cushion feature is inserted between two flexible hinged sole segments, each sole segment being divided into two portions, a sole portion and a heel portion which are fastened together by an adjustable locking mechanism which can adjust the sole cushioning assembly to fit various shoe sizes, the rubber cushion pads being securely fastened to one of the hinged sole segments.

In the second embodiment, a series of springs are inserted between an adjustable hinged sole segment and the rubber cushion pads, the heel portion of the shoe being cushioned by rubber heel pads. In both embodiments, the sole cushioning assembly can be formed as part of the shoe manufacture or can be a separate unit which can be adjusted to accommodate various shoe sizes.

Accordingly, it is an object of the present invention to provide a shoe with a sole cushioning assembly which will protect the feet of a user from injury during use on hard surfaces and provide comfort during long hours of standing on hard or hot or cold surfaces.

Another object of the invention is to provide a sole cushioning assembly for shoes which will prevent foot injury and provide comfort, comprising a spring cushion feature inserted between two flexible hinged sole segments.

Another object of the invention is to provide a sole cushioning assembly for shoes comprising a spring cushion feature fastened to an adjustable hinged sole segment.

A further object of the invention is to provide a sole cushioning assembly for a shoe which comprises a spring cushion feature fastened to a flexible hinge sole segment, that can be a part of the shoe manufacture.

A still further object of the invention is to provide a sole cushioning assembly comprising a spring cushion feature attached to a flexible hinged sole segment, that can be formed as a separate unit and be adjustable so as to fit various shoe sizes.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figures 1, 4A, 4B, 4C, 5, 5A, 6, 7:
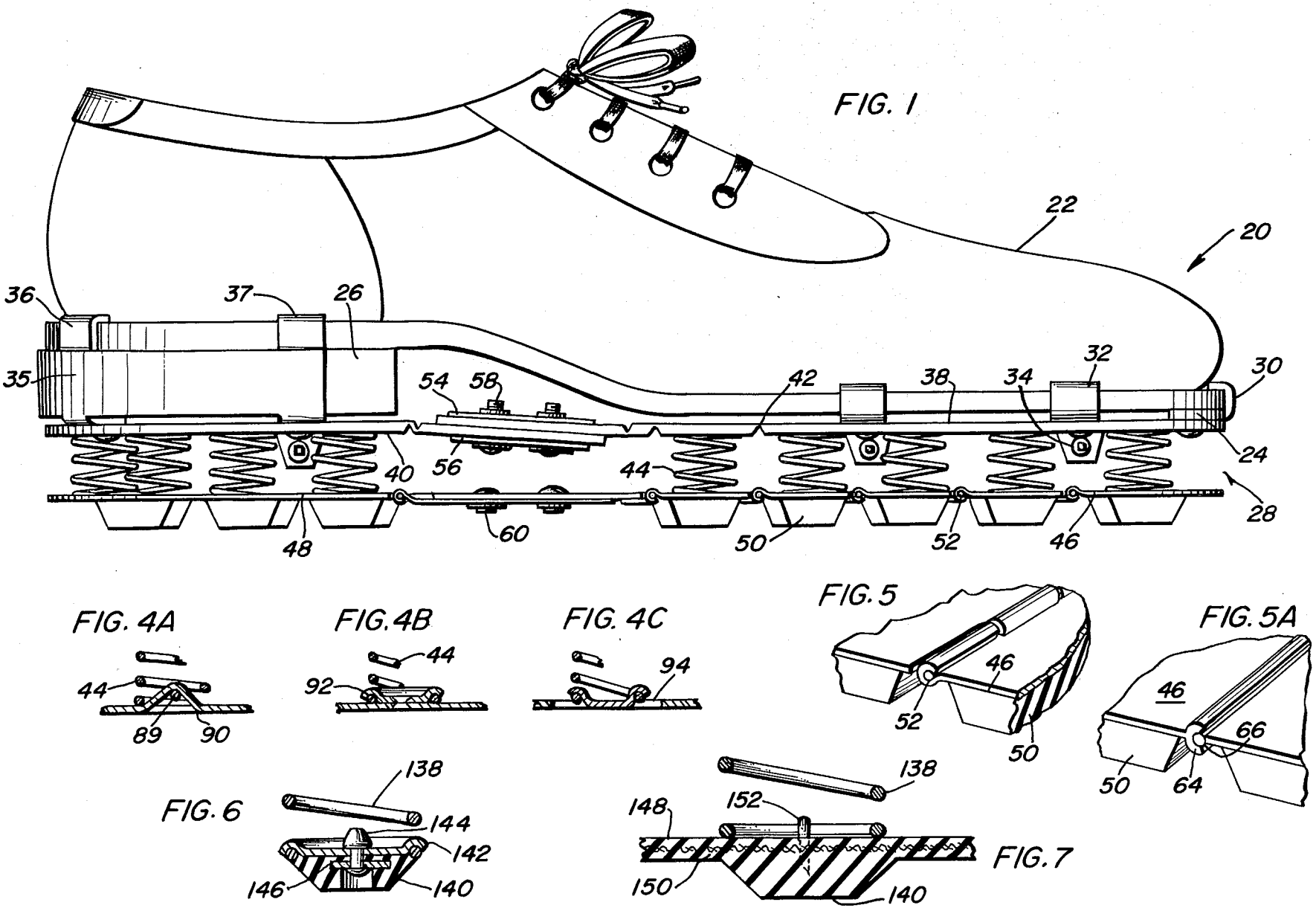
FIG. 1 is a side elevation of a shoe containing the sole cushioning assembly of the present invention fastened to the sole of the shoe.
FIGS. 4A, 4B and 4C are cross-sectional views showing the manner in which the cushion springs can be attached to the hinged sole segments.
FIGS. 5 and 5A are perspective views showing types of hinge constructions for the bottom hinge plates.
FIG. 6 is a cross-sectional view showing one manner in which the rubber cushion pads can be attached to the spring cushions in the sole cushioning assembly that constitutes the second embodiment of the present invention.
FIG. 7 is a cross-sectional view showing an alternative cushion pad structure and a general view of how this structure can be attached to the cushion spring.

The sole cushioning assembly of the present invention includes a spring cushion means inserted between rubber cushion pads and a flexible hinged segment. In FIG. 1, illustrating an embodiment of the invention, a shoe 20 is generally shown containing the conventional shoe upper 22, sole 24 and heel 26. The sole cushioning assembly 28 of the present invention is fastened to sole 24 by toe clamp bracket 30, three adjustable clamp brackets 32 containing adjustable clamp bracket adjusting screw 34, heel clamp 35 containing heel clamp bracket 36 and adjustable heel clamp bracket 37. Sole cushioning assembly 28 includes sole base plate 38, heel base plate 40, both of which are preferably made of a synthetic plastic such as polypropylene and contain a plurality of living hinges 42, V-shaped channels formed in the plates, five of which are shown, load springs 44 inserted between the base plates and sole hinge plates 46 and heel hinge plates 48, and further including rubber cushion pads 50 securely attached to sole hinge plates 46 and heel hinge plates 48. The hinge plates can be formed from metal, plastic, or the like, and are flexibly interconnected by hinge elements 52. Sole cushioning assembly 28 is snugly secured on shoe 20 by adjustable clamp brackets 32 and 37 which can be adjusted to fit the width of sole 24 by turning adjusting screws 34 with a conventional skate key mechanism (not shown). Length adjustment of sole cushioning assembly 28 on shoe 20 is accomplished by slidably adjusting and locking sole base plate 38 with heel base plate 40. Metal locking pressure plates 54 and 56 on sole base plate 38 and heel base plate 40, respectively, retain locking screws 58 thereby locking sole base plate 38 and heel base plate 40 together. Toe clamp bracket 30 and heel clamp bracket 36 are tightly urged against sole 24 of shoe 20 after the lengthwise adjustment is made and the locking screw 58 are set. Sole hinge plates 46 are joined with heel hinge plates 48 by overlapping the hinge plates and securing with adjusting rivets 60. Toe clamp bracket 30, adjustable clamp brackets 32 and heel clamp brackets 36 and 37 are retained on sole base plate 38 and heel base plate 40 by rivets 62.

Figure 2:
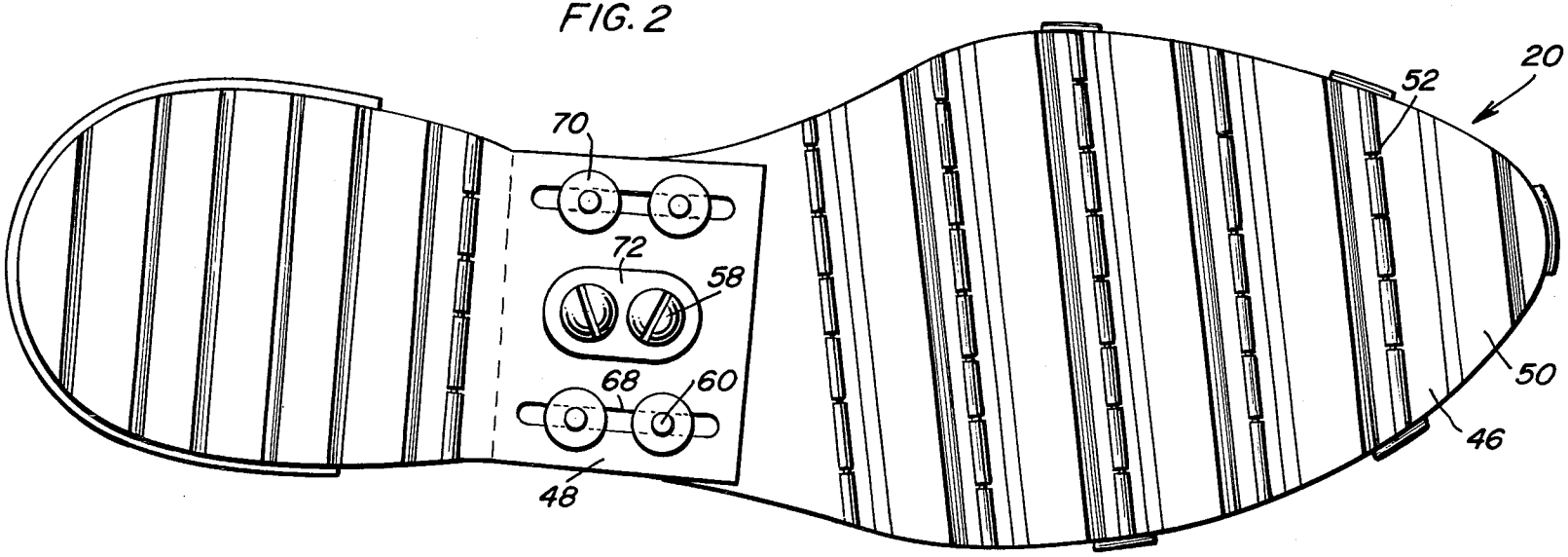
FIG. 2 is a bottom elevational view of the shoe of FIG. 1 containing the sole cushioning assembly.

As illustrated in FIG. 2, rubber cushioning pads 50, vulcanized or otherwise securely fastened to hinge plates 46 and 48, are contoured to match the sole shape and are shown to be transverse elongated members covering the full width of sole 24. Each hinge plate member is flexibly interconnected to another by hinges 52, shown in FIG. 2, as comprising the standard roll form hinge. An enlarged illustration of the type of hinges preferred are shown in FIGS. 5 and 5A. In FIG. 5, the standard roll form hinge is shown flexibly interconnecting sole hinge plates 46 onto which rubber cushion pads 50 are securely attached. In FIG. 5A, an extruded hinge is shown interconnecting hinge plates 46, in which one hinge plate has an end formed from an extruded socket 64 and the other hinge plate has an end formed of an extruded cylinder or ball 66 to form a ball and socket-type hinge arrangement. FIG. 2 shows the mechanism by which sole and heel hinge plates 46 and 48 are fastened together. Hinge plates 46 and 48 contain at least one plate member which overlap one another and which include superimposed longitudinal slots 68 placed on each side of center. Shoulder rivets 60 are placed in washers 70 and slots 68 and secure sole hinge plate 46 with heel hinge plate 48 in a manner which allows sliding front to rear movement. A superimposed center slot 72 formed in the overlapping hinge plate members in hinge plates 46 and 48 provide access to adjustment locking screws 58 for base plates 38 and 40.

Figure 3:
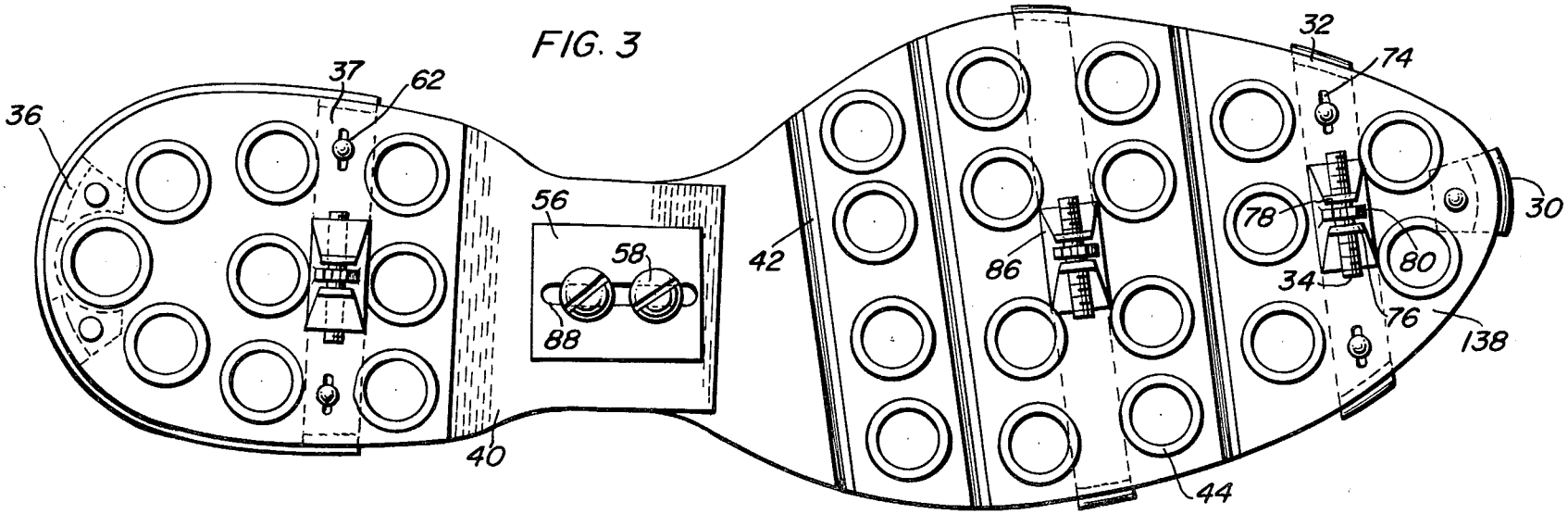
FIG. 3 is a bottom elevational view of the shoe of FIG. 1 with the sole cushioning assembly of the present invention in which the rubber cushion pads and the bottom hinge are removed.
Figures 8, 9, 10:
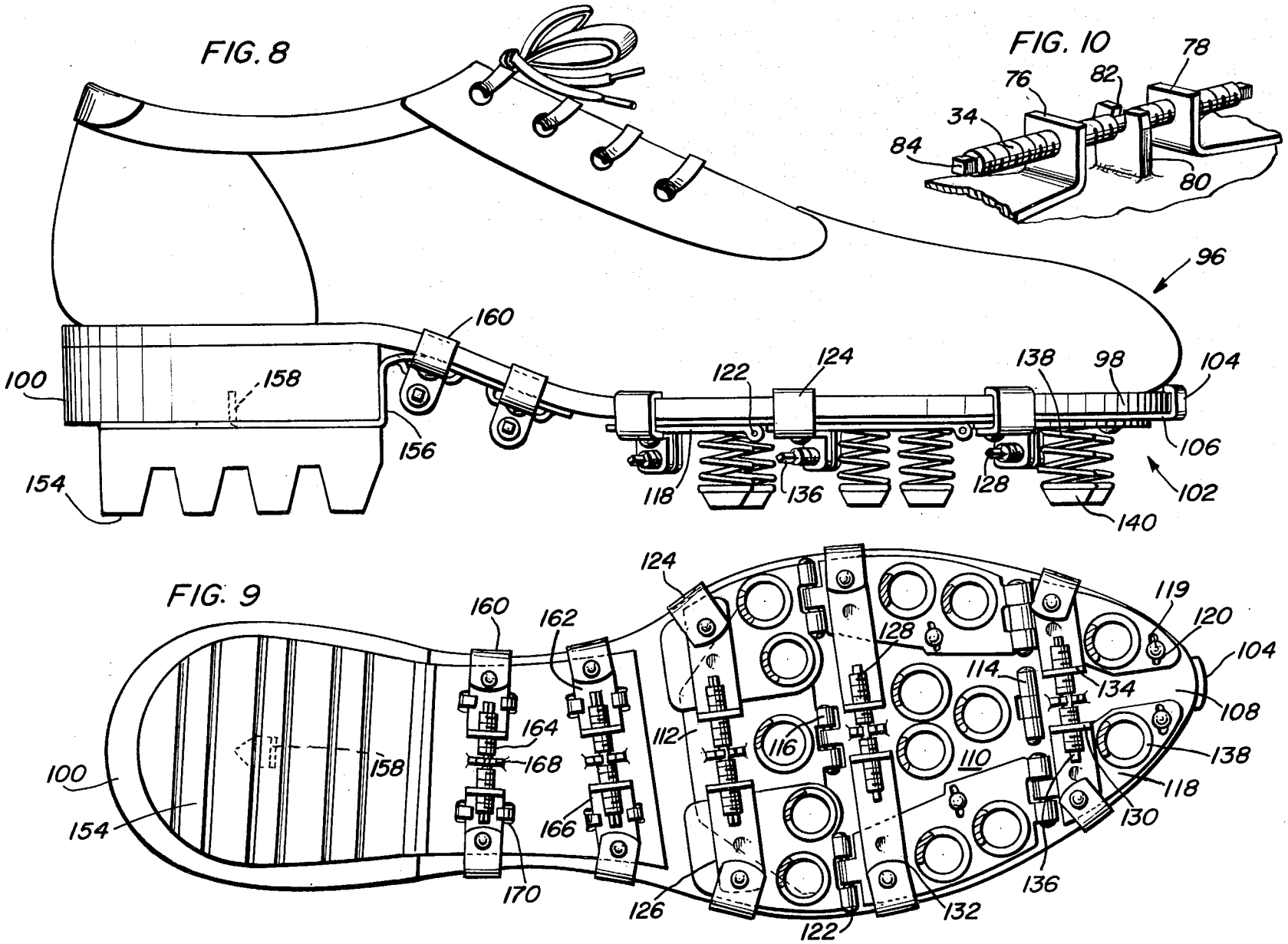
FIG. 8 is a side elevation of a shoe containing a sole cushioning assembly which constitutes the second embodiment of the invention.
FIG. 9 is a bottom view of the shoe of FIG. 8 with the sole cushioning assembly in which the rubber cushion pads are removed.
FIG. 10 is an enlarged perspective view of the screw adjusting mechanism of the adjusting brackets utilized in the present invention.

As seen in the bottom view of FIG. 3, toe clamp bracket 30 grips over the edge of shoe sole 24 and is retained by rivet 62, fastening toe clamp bracket to sole base plate 38. Heel clamp bracket 36 grips over the edge of shoe sole 24 and is fastened to heel base plate 40 by rivets 62. The heel clamp bracket is an integral part of and connected to heel clamp 35 and adjustable heel clamp bracket 37. Adjustable clamp brackets 32 and 37 grip over the sole 24 of shoe 20 and are fastened to base plates 38 and 40 by shoulder rivets 62 which fit into adjustable bracket slots 74 which enables the brackets 32 and 37 to be slidably adjustable. Adjustable clamp brackets 32 and 37 are adjusted by turning left hand and right hand adjusting screw 34. As shown in FIG. 10, left hand and right hand adjusting screws 34 are threaded through flanges 76 and 78 of the clamp brackets and centered by adjustable screw centering piece 80 which includes slot 82 for receiving an undercut diameter section of adjusting screw 34. Adjusting screw centering piece 80 is securely fastened to the base plates 38 and 40 by any suitable means. Clamp adjusting screw 34 can be turned by a skate key mechanism which fits onto the squared-off end 84. A rectangular cutout 86 in the base plate provides adjustment clearance for adjustable clamp brackets 34 and 37. Load springs 44 are securely fastened to the base plates 38 and 40 and are in sufficient number so as to provide enough buoyancy. Load springs 44 can be varied as to the spring wire size, spring diameter, and the placement and number of the springs to provide better balance and weight distribution. The bottom view of FIG. 3 also shows the placement of living hinges 42 on sole base plate 38. Sole base plate 38 and heel base plate 40 are adjustable so as to fit various shoe lengths. A section of sole base plate 38 and heel base plate 40 are overlapped and held by the metal locking pressure plates, metal locking pressure plate 56 being shown. The pressure plates contain superimposed lengthwise adjusting slots 88 into which locking screws 58 are inserted, threaded into metal locking pressure plate 54 which is securely fastened to sole base plate 38.

In FIGS. 4A, 4B and 4C, three mechanisms are shown by which a load spring 44 can be fastened to hinge plates 46 and 48 and even to base plates 38 and 40. In FIG. 4A a shear is formed in the plate and the spring wire of load spring 44 is inserted therethrough and retained by a retaining pin 89 placed over a spring loop of load spring 44 and held by a raised section 90 of the base or hinge plate. In FIG. 4B a cup washer 92 is placed over a spring loop of load spring 44 and either spot welded or riveted to the base plate or hinge plate. In FIG. 4C a series of shear cuts 94 are formed in the plate and the spring wire of load spring 44 is inserted through each cut securing spring 44 to the base or hinge plate.

An alternative embodiment to the sole cushioning assembly 28 shown in FIG. 1 is illustrated in FIGS. 8 and 9 in which shoe 96 contains sole 98 and heel 100. Sole cushioning assembly 102 comprises toe clamp 104 formed as part of hinged base plate 106 formed in three sections as indicated by the dotted lines, toe section 108, center section 110 and rear section 112, flexibly connected by hinges 114 and 116, shown in FIG. 9. Adjustable hinge spring mounting plates 118 are mounted onto hinged base plates 106 by rivets 118, and slidably adjusted along slots 120. Adjustable hinge spring mounting plates are flexibly interconnected by a series of hinges 122 placed near the edge of sole 98. Sole cushioning assembly 102 is fastened to sole 98 of shoe 96 by sole clamp brackets 124 which grip the edge of sole 98. Sole clamp brackets 124 are shoulder riveted to adjustable screw maintaining brackets 126 which hold adjusting screw 128 in the same manner as illustrated in FIGS. 3 and 10. Each adjustable screw maintaining bracket 126 includes flanges 130, screw centering piece 132 which includes slot 134 into which a cutout section of adjusting screw 128 is retained. Left to right adjusting screw 128 can be turned by a skate key-like means which fits onto square end 136 of adjusting screw 128. Clamp brackets 124 and adjustable screw maintaining brackets 126 hold hinged base plate 106 and hinged spring mounting plates 122 securely against sole 98 of shoe 96. Clamp brackets 124 can be adjusted for various shoe widths by turning adjusting screw 128 causing movement of hinged spring mounting plates 122 along slots 120, spring mounting bracket 126 being attached to spring mounting plates 122 through spot welding, or the like. Load springs 138 are fastened to the hinged spring mounting plates 122 by any of the mechanisms shown in FIGS. 4A, 4B or 4C. The end of load springs 138 opposite from the hinged spring mounting plates 122 are attached to rubber tread buttons or pads 140 equivalent to rubber cushion pads 50 of FIG. 1. Load springs 138 are attached to rubber pads 140 by the mechanism shown in FIG. 6 wherein cup washer 142 is placed over a spring wire of load spring 138, the cup washer 142 being fastened to rubber pad 140 by rivet 144 inserted through washer 146 molded in rubber pad 140. Alternatively, rubber tread buttons 140 may be integrally molded into a strip 148 which contains cloth reinforcement 150 as shown in FIG. 7, the strip 148 covering the front length of the shoe which includes the series of pads, as shown in FIG. 8. Load springs 138 can be fastened to strip 148 by any manner shown generally at 152 in FIG. 7. As illustrated in FIG. 8, load springs 138 are not placed over heel 100 of shoe 96 as in the embodiment shown in FIG. 1. In this second embodiment, rubber heel pads 154 are fastened to heel bracket 156 which is secured to heel 100 by tab 158 and two rear sole clamp brackets 160. Each clamp bracket 160 is riveted to adjustable screw maintaining brackets 162 which contains adjustable screw 164 threaded in flanges 166 and centered in screw centering piece 168 in an equivalent manner as shown in FIG. 10, the screw centering piece being welded or otherwise securely fastened to heel bracket 156. Formed tabs 170, part of heel bracket 156 hold and permit sliding of adjustable screw maintaining brackets 162, to provide for adjustment to conform to the contour of the shoe arch section.

Although there are many cushion-type and crepe soled shoes, such cushioning means are directly attached to the shoe sole or inner sole, causing the foot of the user to perspire and eventually become cold due to evaporation. The present invention provides a shoe with a sole cushioning assembly that permits air passage between the rubber cushion pads 50 or 140 in the respective embodiments, that make contact with the floor and the actual shoe sole 24 and 98, insulating the feet of the user from contact with excessive hot or cold surfaces.

Various design modifications can be made to shoe 20 or 96 illustrated in detail in the figures without departing from the scope of the invention. For example, alternate types of pad materials can replace pads 50 and 140 to provide for different uses of the shoe, such as non-slip materials, abrasive materials, etc., that can adapt the shoe for various environments. The cushion pads could also be molded so as to slide into channels formed in the hinge plates 46 and 48 of the embodiment shown in FIG. 1 or into channels formed in web 148 as shown in FIG. 7, so that the shoe can be adapted to various environments by interchanging a commensurate pad type. Metal locking pressure plates 54 and 56 can be replaced by a spring mechanism to pull heel and sole base plates 40 and 38 together for lengthwise adjustment. Further, load springs 44 and 138 can be replaced by synthetic materials, such as a closed cell rubber foam, such replacement would be of lighter weight than conventional metal wire openings. The sole cushioning assembly of the present invention in either embodiment 28 or 102 can be made an integral part of the shoe manufacture by various means, such as vulcanizing the hinge plates to the sole of a shoe, sewing, and the like. The embodiments shown in the figures illustrate a sole cushioning assembly which is a separate unit which is attached to the sole of a shoe. Variations in the type of brackets utilized can be used depending upon the types of materials which form the hinged surfaces, so long as the proper length and width adjustment can be made to accommodate the variations in shoe size. Heel clamp bracket 36 and adjustable heel clamp bracket 37 can also be made slidably adjustable to accommodate the various heel heights which are now common in shoes.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A shoe with a sole cushioning assembly comprising a sole, a substantially flat flexible sole segment juxtaposed with said shoe sole and including a plurality of hinges spaced along the length of said sole segment to provide flexibility to said sole segment, a plurality of cushioning means attached to said sole segment and a plurality of cushion pads associated with said cushioning means, said cushion pads being the surface contacting portion of said shoe and being flexibly mounted substantially along the entire length of said sole.

2. The shoe with sole cushioning assembly of claim 1 wherein said cushion pads are elongated transverse pads which extend substantially the whole width of said shoe sole.

3. The shoe with sole cushioning assembly of claim 1 wherein said sole cushioning assembly is a separate unit which is fastened to the sole of said shoe by a plurality of clamp brackets.

4. The shoe with sole cushioning assembly of claim 3 wherein said plurality of clamp brackets comprises a toe clamp bracket, and a plurality of adjustable clamp brackets placed on the side edge of the sole of said shoe.

5. The shoe with sole cushioning assembly of claim 4 wherein said cushion pads are mounted to a lower substantially flat flexible sole segment comprising a plurality of plates interconnected by hinges and placed between said cushioning means and said pads and wherein said cushioning means is inserted between each flexible sole segment and each of said flexible sole segments substantially extends the total length of said shoe.

6. The shoe with sole cushioning assembly of claim 5 wherein each of said flexible sole segments are divided into two sections, a front sole section which is adjacent the sole of said shoe from said toe to the beginning of the arch of said shoe and a heel section which is adjacent to the heel of said shoe.

7. The shoe with sole cushioning assembly of claim 6 wherein said heel section and said sole section of at least one of said flexible sole segments partially overlap to form a locking section, said locking section including a superimposed longitudinal slot and a screw means fitted into said slot, thereby fastening said heel portion and said sole portion and providing lengthwise slidable adjustment of said one sole segment.

8. The shoe and sole cushioning assembly of claim 7 wherein said heel portion and said sole portion of at least one of said flexible sole segments comprises an overlapping portion, said overlapping portion comprising a slot into which is inserted a rivet means to hold said heel portion to said sole portion and which enables said portions to be slidable in a lengthwise direction.

9. The shoe with sole cushioning assembly of claim 8 wherein said cushioning means inserted between said flexible sole segments is a plurality of load cushion springs.

10. The shoe with sole cushioning assembly of claim 9 wherein said flexible sole segment justaposed with said sole is composed of a flexible plastic material and said hinges flexibly interconnect sections of said sole segment, said hinges being formed by thin grooves extending the full width of the sole of said shoe and the other flexible sole segment comprises a plurality of hinges, said hinges being a standard roll hinge or a ball and socket type hinge.

11. The shoe and sole cushioning assembly of claim 4 wherein said flexible sole segment comprises an upper flexible sole segment adjacent the sole of said shoe and a lower flexible sole segment juxtaposed to said upper sole segment, said cushioning means inserted between said cushion pads and said lower sole segment.

12. The shoe with sole cushioning assembly of claim 11 wherein said cushioning means extends from the toe of said shoe to substantially the beginning of the arch of said shoe.

13. The shoe with sole cushioning assembly of claim 12 further comprising rubber heel pads fastened to the heel of said shoe and providing the contacting surface for said heel.

14. The shoe with sole cushioning assembly of claim 13 wherein said cushioning means are cushion springs.

* * * * *